US009868492B1

(12) United States Patent
Mohrfeld

(10) Patent No.: US 9,868,492 B1
(45) Date of Patent: Jan. 16, 2018

(54) TOOL ASSEMBLY FOR INSTALLING A SUCTION PILE

(71) Applicant: Austin T. Mohrfeld, Tomball, TX (US)

(72) Inventor: Austin T. Mohrfeld, Tomball, TX (US)

( * ) Notice: Subject to any disclaimer, the term of this patent is extended or adjusted under 35 U.S.C. 154(b) by 0 days.

(21) Appl. No.: 15/289,160

(22) Filed: Oct. 8, 2016

(51) Int. Cl.
*B63B 21/27* (2006.01)
*E02D 27/52* (2006.01)
*E02D 7/20* (2006.01)

(52) U.S. Cl.
CPC ..... *B63B 21/27* (2013.01); *E02D 7/20* (2013.01); *E02D 27/525* (2013.01); *E02D 2250/0053* (2013.01)

(58) Field of Classification Search
CPC ..... B63B 21/27
USPC ..... 405/224, 224.1; 114/296
See application file for complete search history.

(56) References Cited

U.S. PATENT DOCUMENTS 6,322,439 B1 11/2001 David
6,719,496 B1 4/2004 Von Eberstein
2006/0127187 A1 6/2006 Raines
2009/0297276 A1 12/2009 Foo et al.
2013/0220206 A1 8/2013 Mogedal
2015/0191220 A1* 7/2015 Mohrfield ..... B63B 21/27 114/296
2016/0090709 A1* 3/2016 Mohrfield ..... B63B 35/4413 49/404

* cited by examiner

*Primary Examiner* — Sunil Singh
(74) *Attorney, Agent, or Firm* — Andrew W. Chu; Craft Chu PLLC

(57) ABSTRACT

The subsea support system includes a suction pile installed underwater without a remote operated vehicle (ROV). A drilling rig or offshore windfarm can be anchored by the suction pile in relatively shallow water with reduced equipment and costs. The system includes a suction pile, a vent valve assembly made integral with the suction pile, and an installation tool assembly removably attached to the vent valve assembly by a clamping device. The system is connected on a vessel before being deployed. Once lowered to the subsea location, the installation tool assembly actuates a seal plate to positions corresponding to closing the suction pile, pumping water through the vent valve assembly to embed the suction pile, and sealing the suction pile at the desired depth. The installation tool assembly can be released by the clamping device to separate from the vent valve assembly and return to the vessel for reuse.

20 Claims, 6 Drawing Sheets

TOOL ASSEMBLY FOR INSTALLING A SUCTION PILE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a suction pile. More particularly, the present invention relates to a suction pile installed without a remote operated vehicle (ROV). Even more particularly, the present invention relates to a subsea support system having a suction pile installed by an installation tool assembly and vent valve assembly.

2. Description of Related Art Including Information Disclosed Under 37 CFR 1.97 and 37 CFR 1.98

A suction pile (also known as a suction caisson, a suction anchor, and a suction bucket) is used to moor a subsea drilling rig, or other pile structure, to the ocean floor. The suction pile is attached to the ocean floor, and rig or offshore windfarm structures are anchored to the attached suction pile. The suction pile is comprised of a generally tubular body, dropped into the water and floated down to the ocean floor. The open end of the tubular body embeds into the ocean floor, like an upside down bucket faced down in the soil. There is a closed end of the tubular body with a vent hatch. The vent hatch has an opened position and a closed position, and a remote operated vehicle (ROV) is used to move the vent hatch between these two positions. The opened position is used during deployment to the ocean floor, with water flowing through the tubular body by the vent hatch. Once landed, the closed position is used to seal the suction pile, so that air and water remaining in the tubular body are pumped out. Soil of the ocean floor is sucked into the tubular body, solidly embedding the suction pile onto the ocean floor. The embedded and filled suction pile forms a solid base for mooring offshore structures.

Suction piles are known as anchoring means for rigs, oil and gas exploration installations, and offshore windfarms.

Variations of suction piles are known in the prior art. For example, United States Patent Publication No. 20060127187, published for Raines on Jun. 15, 2006, discloses a conventional anchor system with a variation on the suction pile structure. There is an elongated hollow anchor element releasably attached to an installation element.

The use of ROV technology to facilitate the embedding of a suction pile is also well known. United States Patent Publication No. 20090297276, published for Foo et al., on Dec. 3, 2009 discloses installation using the ROV instead of an aiming mechanism on the anchoring element of the suction pile. U.S. Pat. No. 6,719,496, issued to Eberstein on Apr. 13, 2004, also describes a system with ROV intervention to install a suction pile. The ROV with pump capability closes the flood valves on the top of the suction pile and attaches to the pumping port of the suction pile. The pump of the ROV operates to draw down the suction pile. The ROV disconnects from the pump port and connects a mooring line to second the load connection.

Variations of the vent hatch or vent cap of the suction pile are also known in the prior art. The primary type of vent hatch for a suction pile is the hinged cap. United States Patent Publication No. 20130220206, published for Mogedal et al on Aug. 29, 2013, shows a vent cap as a hinged cap with a frame to insure alignment of the cap plate over the hatch. Another type of vent hatch is the butterfly valve, shown in U.S. Pat. No. 6,719,496, issued to Eberstein on Apr. 13, 2004, with a cap plate swiveling over the hatch for opening and closure. Some vent hatches are combinations of the hinged cap and the butterfly valves, such as U.S. Pat. No. 6,322,439, issued to David on Nov. 27, 2001. The hinge elements transition between the traditional flipping hinged cap with the cap plate lifted from the hatch and the traditional butterfly vent cap with the cap plate swiveling over the hatch.

It is an object of the present invention to provide an embodiment of a suction pile installed without a remote operated vehicle (ROV).

It is another object of the present invention to provide an embodiment of a suction pile installed by a detachable installation tool having motors.

It is another object of the present invention to provide a subsea system installing a suction pile with a vent valve assembly for sealing and for embedding.

It is still another object of the present invention to provide a subsea system installing a suction pile with a vent valve assembly having a side port for embedding.

It is another object of the present invention to provide an embodiment of a subsea system installing a suction pile at a subsea location with a detachable installation tool.

It is still another object of the present invention to provide a subsea system installing a suction pile with an installation tool assembly having a detachable connection to a vent valve assembly on the suction pile.

It is an object of the present invention to provide an embodiment of a subsea system installing a suction pile with retrievable components.

It is another object of the present invention to provide a subsea system with a suction pile, vent valve assembly and a detachable installation tool deployed from a surface while attached together as a single unit.

It is still another object of the present invention to provide a subsea system with a suction pile anchored by a detachable installation tool with motors to be retrieved from the subsea location.

These and other objectives and advantages of the present invention will become apparent from a reading of the attached specification.

BRIEF SUMMARY OF THE INVENTION

Embodiments of the present invention include a subsea support structure comprised of a suction pile. The suction pile can be used to anchor an offshore drilling rig or windfarm. The suction pile can be placed in deep water or relatively shallow water, depending upon the purpose of installation (drilling rig, windfarm, etc.) supported by the suction pile. The installation can have cranes, helipads, drills, turbines, windmills, and other components. The present invention includes a suction pile, a vent valve assembly, and an installation tool assembly. The suction pile is comprised of a generally cylindrical body having a top pile surface with a pile vent opening on a closed end and a pile skirt on an opened end, and the vent valve assembly is made integral with the pile vent opening. The installation tool assembly is removably attached to the vent valve assembly by a clamping device.

The vent valve assembly of the present invention can include a top vent valve plate, a lower connection interface made integral with the top vent valve plate, and a center stem assembly extending through the top vent valve plate. A plurality of vent valve stem assemblies connects the top vent valve plate to a bottom vent valve body. The bottom vent valve body has a tubular connection portion made integral with the pile vent opening, a first sealing portion, a second sealing portion, and a side port portion between the first and second sealing portions. A seal plate is attached to the center stem assembly so that rotating the center stem assembly actuates the seal plate up and down the center stem assembly. The seal plate can be set in the first sealing portion, the second sealing portion, or the side port portion of the bottom vent valve body. A rod guide in the bottom vent valve body aligns the center stem assembly.

The installation tool assembly of the present invention can include a lower mounting plate being removably engaged to the top vent valve plate and having a center lower mounting hole. The lower connection interface of the vent valve assembly inserts through the center lower mounting hole, so that a clamp centered on the lower mounting plate can engage the lower connection interface. There is a first motor attached to the lower mounting plate to actuate the clamp. The installation tool assembly also includes an upper mounting plate attached to the lower mounting plate and having a center upper mounting hole aligned with the center lower mounting hole. An upper connection interface attached to the bottom side of the upper mounting plate extending downward to contact the lower mounting plate in the clamp on the lower mounting plate. The clamp works to connect the vent valve assembly to the installation tool assembly.

Embodiments of the installation tool assembly further include a locking means actuated by a second motor on a top side of the upper mounting plate. The locking means stops rotation of the center stem assembly so that the seal plate can be held in different positions within the bottom vent valve body. In some embodiments, the seal plate in a second sealed position corresponds to actuating the stop member to prevent rotation of the center stem assembly. There is a top installation tool plate attached to the upper mounting plate and the lower mounting plate by a plurality of installation tool stem assemblies extending through all three plates. A third motor is mounted on a lower side of the top installation tool plate, and the third motor rotates a hex drive rod extending down through the upper connection interface and connecting to the center stem assembly of the vent valve assembly. The third motor of the installation tool assembly can drive the seal plate of the vent valve assembly.

In the present invention, the vent valve assembly must be able to seal and to embed the suction pile. To embed, there is a side port opening in the side port portion of the bottom vent valve body. The seal plate can be set in the second sealed portion to open the side port opening. Water can be suctioned from the suction pile and bottom vent valve body to anchor the suction pile into the soil. The seal plate can be lowered to the first sealed portion to close the side port opening and the suction pile, when the suction pile is set at the desired depth. In some embodiments, a tubular member is attached to the side port opening to remove the water, and the lower mounting plate, the upper mounting plate, and the top installation tool plate can have ring frames to support the tubular member. The lower mounting plate and the upper mounting plate can also have accessory plates to protect the first motor between the mounting plates.

Embodiments of the clamp of the present invention include a first arcuate arm with a first locking groove, and a second arcuate arm with a second locking groove. The first motor has an actuating member to move the arcuate arms closer together to clamp and farther apart to release. The lower connection interface and the upper connection interface fit into both grooves cooperatively in a locked connection of the vent valve assembly and the installation tool assembly.

Embodiments of the present invention include the method for installation of a subsea support structure. The system is assembled on barge at the surface before being deployed subsea. The clamp is opened, and the hex drive rod is inserted into the center stem assembly. The lower connection interface and the upper connection interface cooperative fit within locking grooves of the clamp, and then the clamp is closed. The hex drive rod rotates by the third motor to raise the seal plate above the bottom vent valve body for a opened position. Then, the entire system is deployed to the subsea location.

Once the suction pile is self-embedded by weight, the seal plate is closed to the second sealed position, which opens the side port opening and closes the bottom vent valve body and suction pile. Water is pumped from the suction pile and bottom vent valve body to suction soil and set the suction pile to the desired depth. At the desired depth, the seal plate is actuated to the first sealed position to close the side port opening and the suction pile. The suction pile is now anchored in place at the desired depth.

The clamp is now opened again by the first motor. The lower connection interface separates from the upper connection interface, and the hex drive rod releases from the center stem assembly as the installation tool assembly is raised toward the surface. The installation tool assembly is now released and can be returned to the surface for reuse. When there is a tubular member connected to the side port opening, the tubular member must also be separated from the vent valve assembly. Various connections to the surface, such as motor umbilicals and tubular member pumps, can be attached to the structure of the present invention to provide power and suction.

DETAILED DESCRIPTION OF THE INVENTION

Offshore installations or facilities can have cranes, helipad, turbines, generators, windfarms, and other equipment to sustain industrial processes and human lives in the middle of the ocean. The equipment is heavy and difficult to transport, so permanent placement in the ocean requires a strong support structure with anchoring to the ocean floor. The anchoring includes subsea support structures comprised of suction piles. A suction pile is deployed from the surface and lowered to the subsea location. The suction pile is embedded into the soil to anchor other supports for the offshore installation. The present invention provides a subsea support structure comprised of a suction pile to be installed without less equipment and without a remote operated vehicle (ROV).

Figure 1:
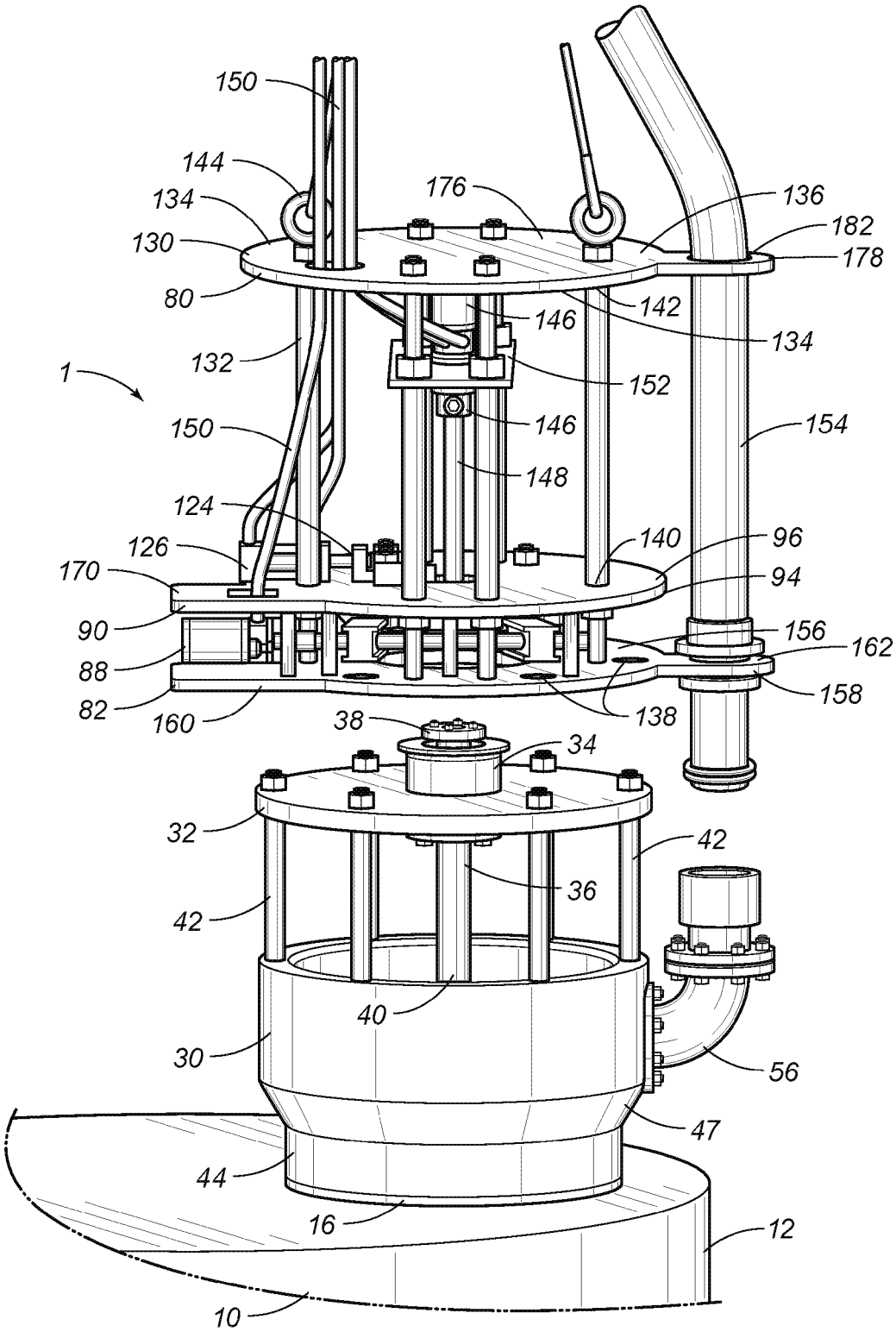
FIG. 1 is an exploded perspective view of an embodiment of the subsea system of the present invention before being assembled on barge at a surface location.
Figure 2:
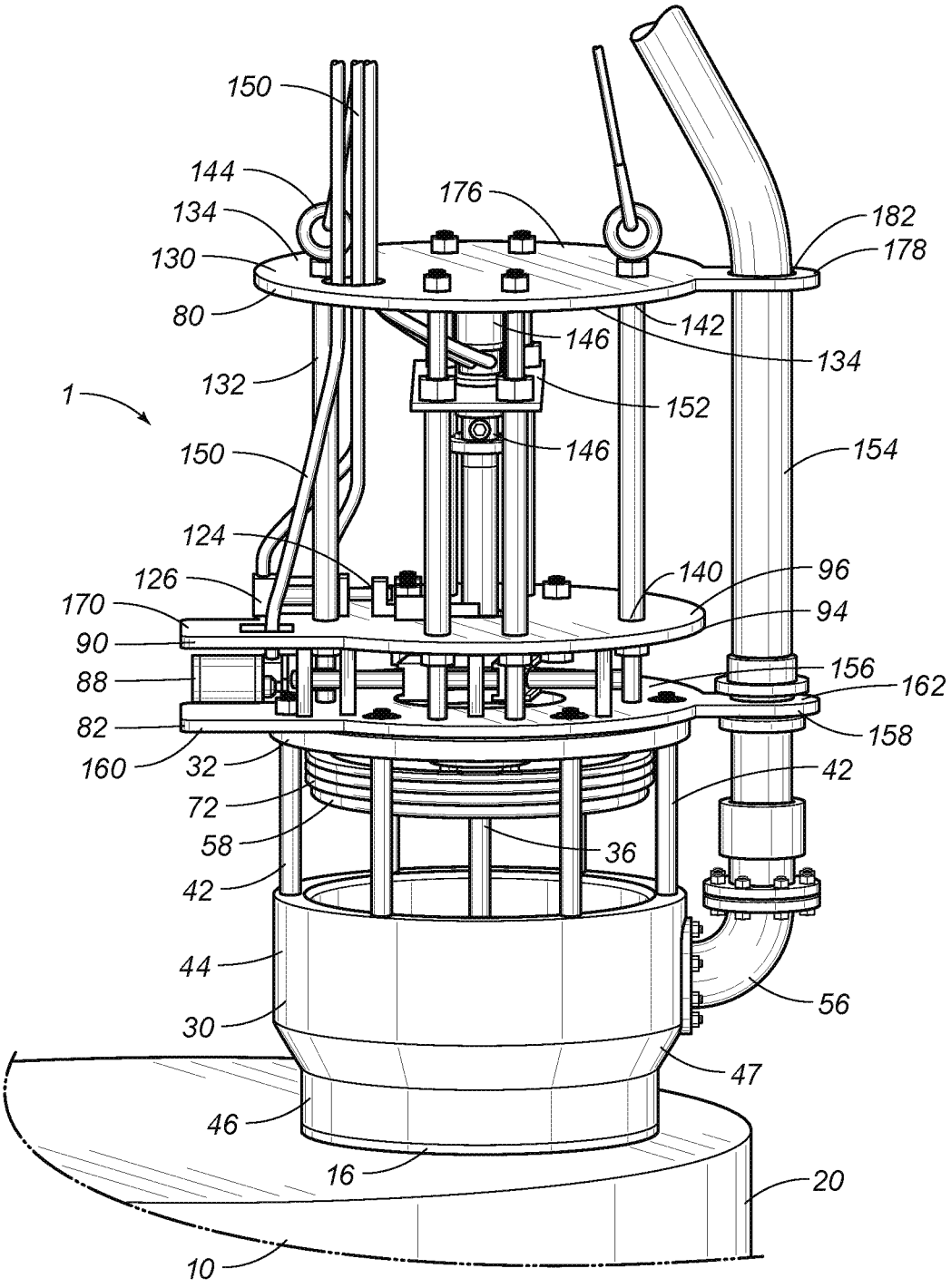
FIG. 2 is a perspective view of an embodiment of the subsea system of the present invention as assembled on barge at a surface location before being deployed.
Figure 3:
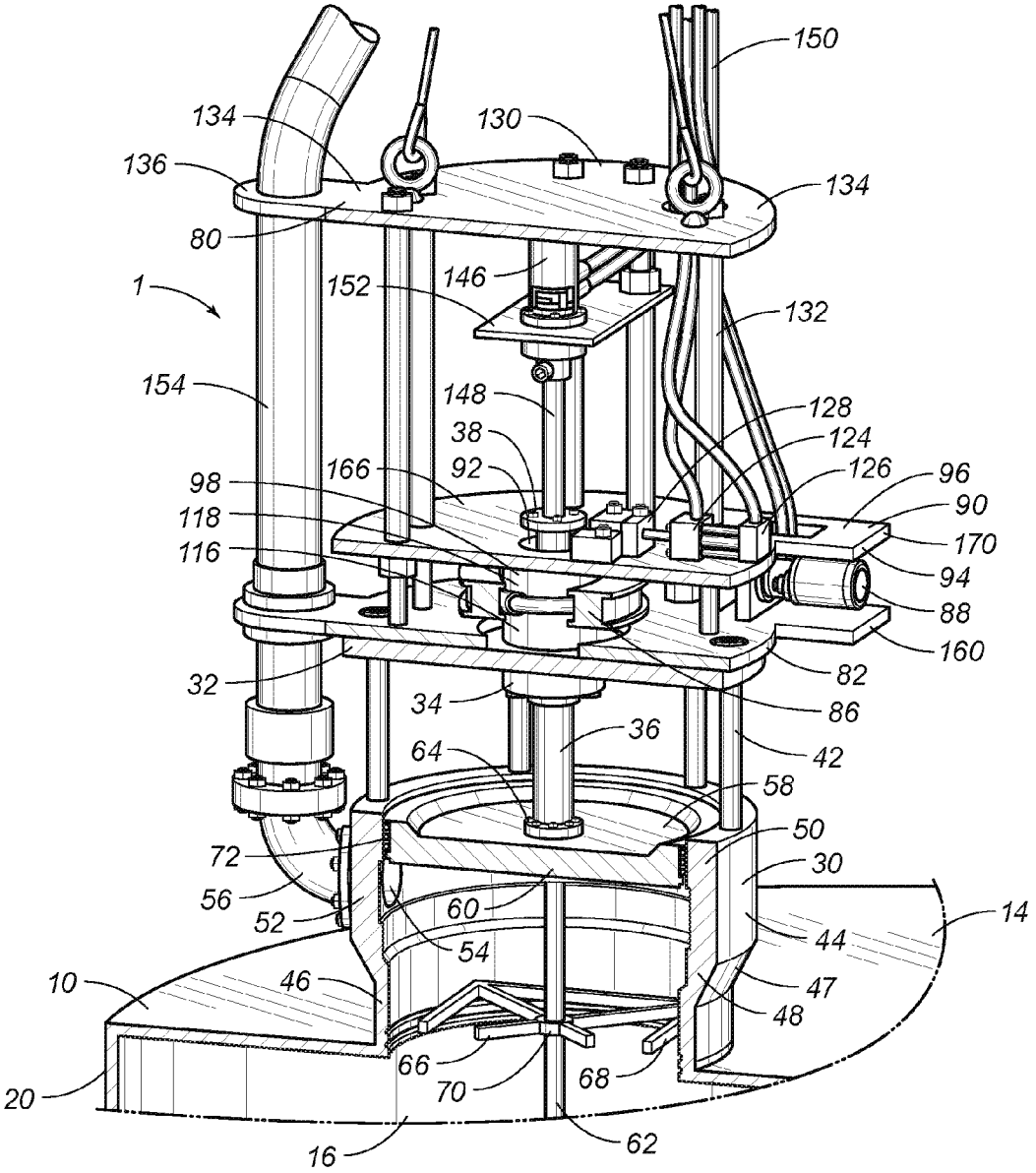
FIG. 3 is a partial perspective and cross-sectional view of an embodiment of the subsea system of the present invention at the subsea location with a seal plate in the second sealed position for embedding to a desired depth.
Figure 4:
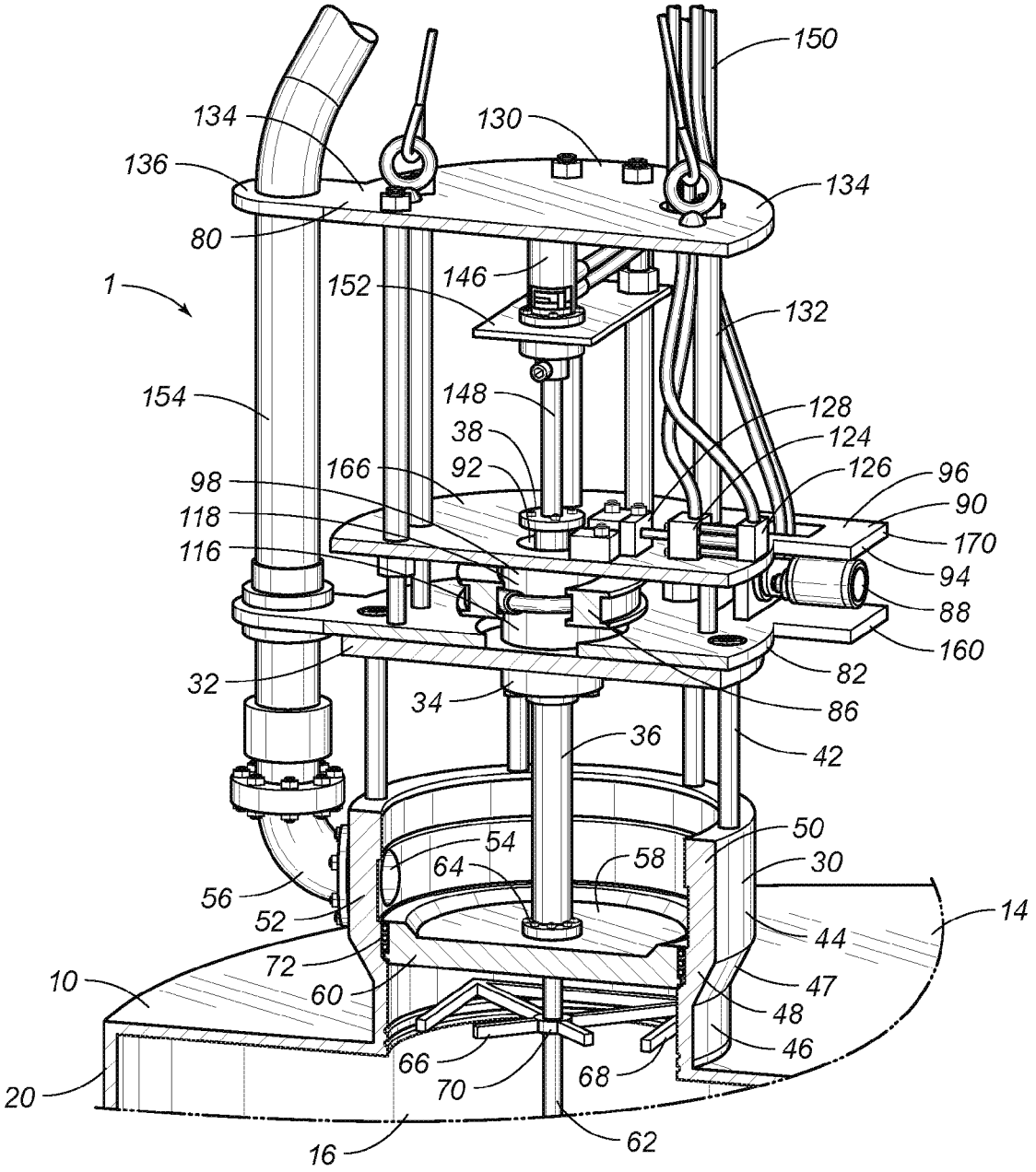
FIG. 4 is a partial perspective and cross-sectional view of an embodiment of the subsea system of the present invention with the suction pile at the desired depth and with the seal plate in the first sealed position.

FIGS. 1-5 show the subsea support structure 1 comprised of a suction pile 10. The suction pile 10 is comprised of a generally cylindrical body 12 having a top pile surface 14 with a pile vent opening 16 on a closed end 18 and a pile skirt 20 on an opened end. FIGS. 3 and 4 show the closed end 18 and pile vent opening 16, and only upper portions of the pile skirt 20 are seen. The opened end is not shown in the Figures, but the opened end is a known component of a suction pile in the prior art. The pile skirt 20 and opened end of the suction pile 10 are the same pile skirt and opened end of known suction piles. FIGS. 1-6 show the vent valve assembly 30 made integral with the pile vent opening 16 and the installation tool assembly 80 removably attached to the vent valve assembly 30.

The vent valve assembly 30 of the present invention can include a top vent valve plate 32, a lower connection interface 34 made integral with the top vent valve plate 32, and a center stem assembly 36 extending through the top vent valve plate 32. FIGS. 2-4 show the center stem assembly being comprised of a lower center stem connector 38 and a lower threaded center stem bolt body 40. The lower center stem connector 38 is mounted on an end of the lower threaded center stem bolt body 40 above the lower connection interface 34. The lower threaded center stem bolt body 40 is rotatable within the lower connection interface 34.

A plurality of vent valve stem assemblies 42 connects the top vent valve plate 32 to a bottom vent valve body 44. Each vent valve stem assembly 42 is arranged on an edge of the bottom vent valve body 44 facing and extending upward toward the top vent valve plate 32. The vent valve stem assemblies 42 maintain position of the top vent valve plate 32 relative to the bottom vent valve body 44. FIGS. 1-6 show the vent valve stem assemblies 42 are tubular members with large washers and bolts for attachment to the top vent valve plate 32. The vent valve stem assemblies 42 are set around the circumference of the bottom vent valve body 44.

FIGS. 3-4 show cross-sectional views of the bottom vent valve body 44 of the present invention. The bottom vent valve body 44 has a tubular connection portion 46 made integral with the pile vent opening 16 of the suction pile 10. The connection portion 46 can be welded or otherwise attached permanently to the suction pile 10. There is a first sealing portion 48 adjacent to the other side of the tubular connection portion 46. In some embodiments, the diameter of the tubular connection portion 46 is smaller than the diameter of the first sealing portion 48. There can be a transition zone 47 with an angled conical surface between the tubular connection portion 46 and the first sealing portion 48. The bottom vent valve body 44 also has a second sealing portion 50 and a side port portion 52 between the first and second sealing portions 48, 50. FIGS. 1-6 also show the side port portion 52 being comprised of a side port opening 54 through the bottom vent valve body 44 and a side port connector 56 in fluid connection with the side port opening 54 on an exterior of the side port portion 52.

Embodiments of the seal plate 58 are shown in FIGS. 2-4 and 6. The seal plate 58 is attached to the center stem assembly 36 so that rotating the center stem assembly 36, in particular, the lower threaded center stem bolt body 40, actuates the seal plate 58 up and down the center stem assembly 36. FIGS. 2-4 show the seal plate 58 at various positions along the lower threaded center stem bolt body 40. The seal plate 58 is comprised of a circular plate body 60, a bottom alignment pin 62 extending downward from the circular plate body 60, and a stem retainer 64 connecting the circular plate body 60 to the lower threaded center stem bolt body 40. The stem retainer 64 is centered on the circular plate body 60. There is a rod guide 66 being comprised of a frame 68 with a center frame hole 70 aligned with the bottom alignment pin 62. The rod guide 66 supports the vertical orientation of the seal plate 58 and alignment with the lower threaded center stem bolt body 40 and the installation tool assembly 80.

FIGS. 2-4 also show the seal plate 58 having an opened position, a second sealed position, and a first sealed position. FIG. 2 is the opened position with the seal plate 58 above the bottom vent valve body 44. The suction pile 10 and the bottom vent valve body 44 are open and can fill with water as the system 1 is deployed subsea. FIG. 3 shows the seal plate 58 in the second sealed position with the seal plate 58 closed against the second sealing portion 50 of the bottom vent valve body 44. The second sealed position corresponds to fluid connection between the side port portion 52 and the side port connector 56. Water can flow through the side port opening 54 to be removed from the suction pile 10, embedding the suction pile 10 deeper into the soil to a desired depth. FIG. 4 shows the first sealed position closing the seal plate 58 to the first sealing portion 48 of the bottom vent valve body 44. The first sealed position corresponds to closing the tubular connection portion 46 to the side port portion 52 of the bottom vent valve body 44. The suction pile 10 is sealed in the first sealed position. Water can no longer be emptied from the suction pile 10 through the side port opening 54. When the suction pile 10 is at the desired depth, the suction pile 10 is sealed with the seal plate 58 closed against the first sealing portion 48.

In some embodiments, there is a sealing means 72 around a perimeter of the circular plate body 60 of the seal plate 58.

FIGS. 3 and 4 show the sealing means 72 as O-rings. Other known devices for a liquid tight seal may also be sealing means 72 of the present invention.

FIGS. 1-6 show the installation tool assembly 80 of the present invention. The installation tool assembly 80 is detachable from the vent valve assembly 30. The installation tool assembly 80 provides the power, control, and equipment to replace remote operated vehicles (ROV). Instead of piloting an ROV through underwater conditions, the same operations to the suction pile 10 can be performed at the subsea location, while controlled at the surface.

Figure 6:
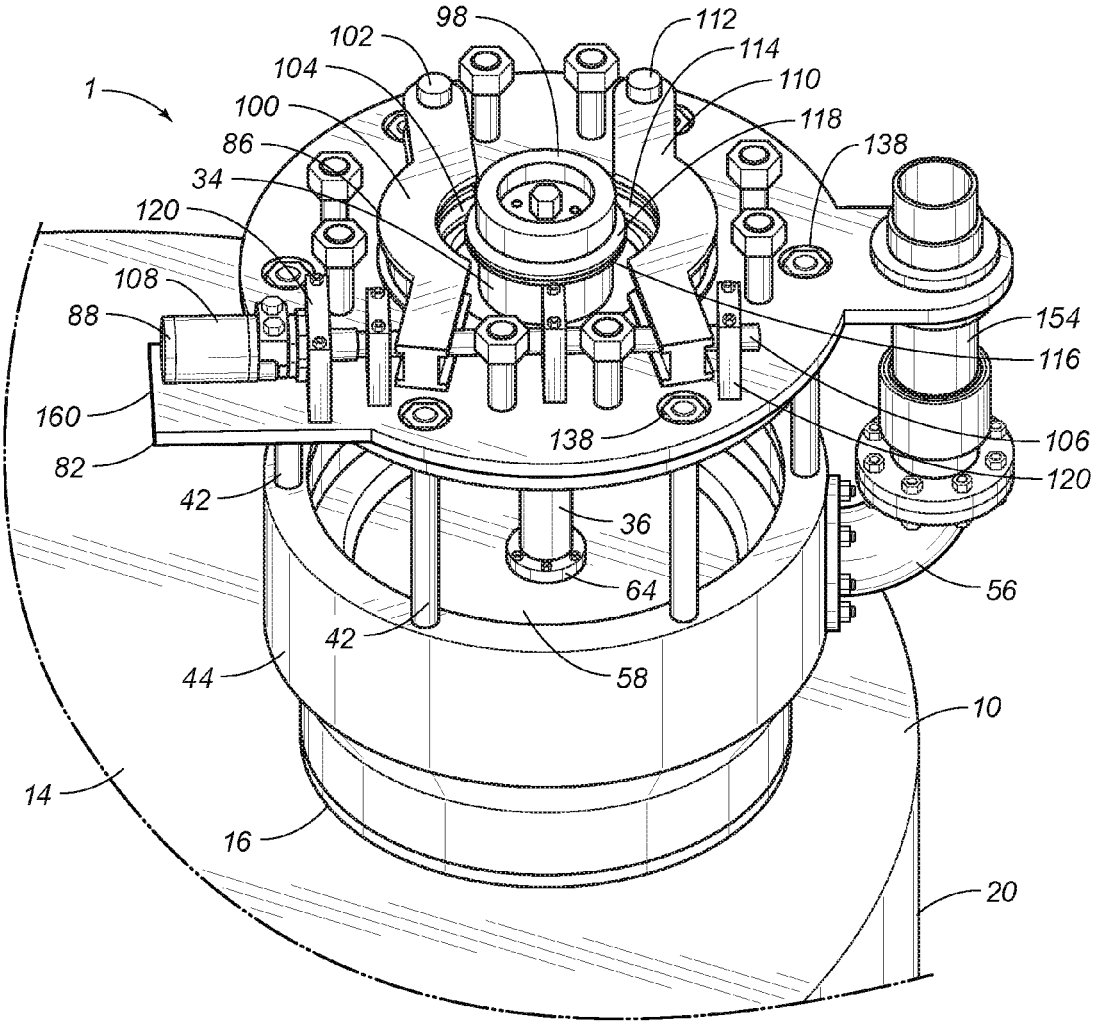
FIG. 6 is an isolated upper perspective view of an embodiment of the clamp on the lower mounting plate of the installation tool assembly.

The installation tool assembly 80 includes a lower mounting plate 82 removably engaged to the top vent valve plate 32. The lower mounting plate 82 of the installation tool assembly 80 and the top vent valve plate 32 of the vent valve assembly 30 abut each other when the installation tool assembly 80 and the vent valve assembly 30 are connected. The lower mounting plate 82 has a center lower mounting hole 84 aligned with the center stem assembly 36 of the vent valve assembly 30. The lower connection interface 34 of the vent valve assembly 30 can insert through the center lower mounting hole 84, so that a clamp 86 centered on the lower mounting plate 82 can engage the lower connection interface 34. The installation tool assembly 80 further includes a first motor 88 attached to the lower mounting plate 82 and the clamp 86. The first motor 88 actuates the clamp 86 to open and close. FIG. 6 shows an isolated perspective view of an embodiment of the clamp 86 on the lower mounting plate 82.

FIGS. 1-5 show the installation tool assembly 80 having an upper mounting plate 90 attached to the lower mounting plate 82 and having a center upper mounting hole 92 aligned with the center lower mounting hole 84. The upper mounting plate 90 has a bottom side 94 facing the lower mounting plate 82 and a top side 96 opposite the bottom side 94. FIGS. 3 and 4 show an upper connection interface 98 attached to the bottom side 94 of the upper mounting plate 82. The upper connection interface 98 can extend downward toward the lower mounting plate 82 so as to contact the lower connection interface 34 of the vent valve assembly 30 within the clamp 86 on the lower mounting plate 82. The clamp 86 opens to separate the installation tool assembly 80 from the vent valve assembly 30 and the suction pile 10 and closes to connect the installation tool assembly 80 to the vent valve assembly 30 and the suction pile 10.

An embodiment of the clamp 86 is shown in detail in FIG. 6. The clamp 86 can have a first arcuate arm 100 with a first pivot point 102 and a first locking groove 104, and a second arcuate arm 110 with a second pivot point 112 and a second locking groove 114. The first arcuate arm 100 and the second arcuate arm 110 are complementary and work cooperatively. The first locking groove 104 and the second locking groove 114 both face toward the center lower mounting hole 84. The lower connection interface 34 and the upper connection interface 98 are friction fit within the first locking groove 104 and the second locking groove 114 when the vent valve assembly 30 and the installation tool assembly 80 are connected. The first locking groove 104 and the second locking groove 114 cooperative engage the lower connection interface 34 and the upper connection interface 98. Both the lower connection interface 34 and the upper connection interface 98 fit inside the locking grooves 104, 114 at the same time, such that closing the arcuate arms 100, 110 traps the lower connection interface 34 and the upper connection interface 98 within the locking grooves 104, 114. The first motor 88 has an actuating member 106 to move the arcuate arms 100, 110 closer together to close and connect and farther apart to open and release.

FIG. 6 shows an embodiment of the first motor 88 with a motor unit 108 and the actuating member 106. The actuating member 106 engages each arcuate arm 104, 114. The first arcuate arm 100 rotates on the first pivot 102 toward the second 110 arcuate arm to close. The second arcuate arm 110 rotates on the second pivot 112 toward the first arcuate arm 100 to close. The movement of both arcuate arms 100, 110 to close traps the lower connection interface 34 and the upper connection interface 98 together in the locking grooves 104, 114 for a closed clamp position. In reverse, the first arcuate arm 100 rotates on the first pivot 102 away from the second 110 arcuate arm to open. The second arcuate arm 110 rotates on the second pivot 112 away from the first arcuate arm 100 to open. The lower connection interface 34 and the upper connection interface 98 can escape the locking grooves 104, 114 and separate from each other.

FIGS. 3 and 4 show embodiments of the lower connection interface 34 and the upper connection interface 98. The lower connection interface 34 can be comprised of a lower flanged end 116, and the upper connection interface 98 can be comprised of an upper flanged end 118. The lower flanged end 116 is adjacent to the upper flanged end 118 within the first locking groove 104 and the second locking groove 114, when the vent valve assembly 30 and the installation tool assembly 80 are attached. The flanged ends 116, 118 can be released from the locking grooves 104, 114, when the vent valve assembly 30 and the installation tool assembly 80 are released. FIG. 6 also shows a locking frame 120 mounted on the lower mounting plate 82 comprised of brackets 122. The brackets 122 of the locking frame 120 align the actuating member 106 to the first arcuate arm 100 and the second arcuate arm 110 and support the attachment of the first motor 88 to the lower mounting plate 82.

Embodiments of the installation tool assembly 80 further include a locking means 124 actuated by a second motor 126 on a top side 96 of the upper mounting plate 90 in FIGS. 1-4. The locking means 124 stops rotation of the center stem assembly 36 so that the seal plate 58 can be held in different positions within the bottom vent valve body 44. The locking means 124 can be comprised of a stop member 128. A locked position has the stop member 128 preventing rotation of the center stem assembly 36. The stop member 128 can be a bolt, plug, cam or any known device to be actuated by the second motor 126. FIG. 3 shows the seal plate 58 in a second sealed position corresponding to actuating the stop member 128 to prevent rotation of the center stem assembly 36. The stop member 128 is shown as an L-shaped block to friction fit stop the rotation. FIG. 4 shows the stop member 128 retracted to the second motor 126 to allow the rotation. The locking means 124 is a mechanical stop to the rotation.

FIGS. 1-5 show the installation tool assembly 80 having a top installation tool plate 130 attached to the upper mounting plate 90 and the lower mounting plate 82 by a plurality of installation tool stem assemblies 132 extending through all three plates 82, 90, 130. The top installation tool plate 130 has a lower side 134 facing the top side 96 of the upper mounting plate 90 and an upper side 136 opposite the lower side 134. Each installation tool stem assembly 132 is arranged around the center mounting hole 84 of the lower mounting plate 82 and face upward toward the top installation tool plate 130.

Embodiments with the installation tool stem assemblies 132 show the alignment of the vent valve assembly 30 and the installation tool assembly 80. The lower mounting plate 82 is adjacent and contacts the top vent valve plate 32. FIGS.

1-4 further show how the lower mounting plate 82 can have a plurality of peripheral holes 138. Each peripheral hole 138 aligns with a corresponding vent valve stem assembly 42. The top ends of the vent valve stem assemblies 42 can be removably inserted in the peripheral holes 138, when the installation tool assembly 80 is attached in FIGS. 2-4. The peripheral holes 138 can assist in alignment.

The upper mounting plate 90 can also be comprised of a plurality of upper stem holes 140, and the top installation plate 130 can be comprised of a plurality of tool plate holes 142. Each upper stem hole 140 and each tool plate hole 142 are aligned with a corresponding installation tool stem assembly 132, such that the corresponding installation tool stem assembly 132 inserts through a respective upper stem hole 140 and a respective tool plate stem hole 142. The installation tool stem assemblies 132 stabilize position of the plates 82, 90, 130 relative to each other and maintain alignment. In additional embodiments of FIGS. 1-5, there is a connection means 144 above the upper side 136 of the top installation tool plate 130. The connection means 144 can be hooks, loops, eye-nuts or other known devices to transport the installation tool assembly 80. The connection means 144 attach to at least one installation tool stem assembly 132 so that vessel equipment, such as a crane can be attached to lift the installation tool assembly 80 above the vent valve assembly 30 on the suction pile 10. The connection means 144 allows the installation tool assembly 80 to be deployed and to be retrieved from the subsea location.

The installation tool assembly 80 further includes a third motor 146 mounted on a lower side 134 of the top installation tool plate 130. FIGS. 1-5 show the third motor 146 rotating a hex drive rod 148 extending down from the third motor 146 and through the upper connection interface 98 and connecting to the center stem assembly 36 of the vent valve assembly 30. The third motor 146 of the installation tool assembly 80 drives the hex drive rod 148, which drives the rotation of the lower threaded center stem bolt body 40 of the center stem assembly 36. Thus, the seal plate 58 on the lower threaded center stem bolt 40 moves up and down along the lower threaded center stem bolt 40 according to the rotation. The seal plate 58 can be moved within the vent valve assembly 30. FIGS. 1-5 also show a support plate 152 positioned by corresponding installation tool stem assemblies 132 aligned through the top installation tool plate 130, upper mounting plate 90, and lower mounting plate 82. The third motor 146 is fixedly attached to the support plate 152 underneath the top installation tool plate 130. The third motor 146 is protected between the support plate 152 and the top installation tool plate 130.

In the embodiments with the hex drive rod 148, the locked position of the stop member 128 corresponds to the stop member 128 in friction fit engagement with the hex drive rod 148. The edge of an L-shaped block abuts a hex surface of the hex drive rod 148 so that the hex drive rod 148 cannot rotate. The unlocked position of the stop member 128 corresponds to the stop member 128 releasing from friction fit engagement with the hex drive rod 148. Actuating the stop member 128 with the second motor 126 to retract the edge from the hex surface allows the hex drive rod 148 to rotate. FIG. 3 shows the stop member 128 in the locked position, when the seal plate 58 is in the second sealed position. FIG. 4 shows the stop member 128 in the unlocked position.

FIGS. 1-5 also show a plurality of motor umbilicals 150 attached to the installation tool assembly 80. Each motor umbilical 150 connects to a respective motor 88, 126, 146 to provide power from a surface location. Instead of a remote operated vehicle (ROV), motor umbilicals supply a stable source of power and electricity to the subsea location without navigating ocean currents and piloting the ROV through difficult conditions. The motors 88, 126, 146 are mounted on the installation tool assembly 80 in alignment. Again, currents and swells affecting an ROV are no longer factors with the motors 88, 126, 146 in a permanent alignment with actuating structures.

In the present invention, the vent valve assembly 80 must be able to seal and to embed the suction pile 10. To embed, there is a side port opening 54 in the side port portion 52 of the bottom vent valve body 44. The seal plate 58 can be set in the second sealing portion 50 to open the side port opening 54. Water can be suctioned from the suction pile 10 and bottom vent valve body 44 to anchor the suction pile 10 into the soil. The seal plate 58 can be lowered to the first sealing portion 48 to close the side port opening 54 and the suction pile 10, when the suction pile 10 is set at the desired depth.

FIGS. 1-5 show the components to remove the water from the suction pile 10 for embedding. A tubular member can be attached to the side port opening 54 through the side port connector 56 for fluid connection to the bottom vent valve body 44 and suction pile 10 so as to remove the water. The tubular member 154 can be attached at another end to surface equipment or other devices to pump the water from the suction pile 10 for embedding. The tubular member 154 may not reach the surface. A sump can vent the water subsea, without needing to pump vented water all the way to the surface. The tubular member 154 is removably attached to the side port connector 56 so that the tubular member 154 can be reused for other suction piles.

In the present invention, the tubular member 154 can be supported by the installation tool assembly 80. The connection and removal of the tubular member 154 can be coordinated with the installation tool assembly 80. FIGS. 1-6 show the lower mounting plate 82 being comprised of a lower circular mounting portion 156 complementary to the top vent valve plate 32, a lower ring extension 158 radial to the lower circular mounting portion 156, and a lower accessory plate 160 extending from the lower circular mounting portion 156. The center lower mounting hole 84 remains centered in the lower circular mounting portion 156. The upper mounting plate 90 and the top installation plate 130 match the lower mounting plate 82. The upper mounting plate 90 can be comprised of an upper circular mounting portion 166 complementary to the lower circular mounting portion 156, an upper ring extension 168 radial to the upper circular mounting portion 166 and aligned with the lower ring extension 158, and an upper accessory plate 170 extending from the upper circular mounting portion 166 and aligned with the lower accessory plate 160. Similarly, the center upper mounting hole 92 remains centered in the upper circular mounting portion 166. Also, the top installation plate 130 can be comprised of a top circular mounting portion 176 complementary to the upper circular mounting portion 166 and the lower circular mounting portion 156, and a top ring extension 178 radial to the top circular mounting portion 176 and aligned with the upper ring extension 168 and the lower ring extension 158.

FIGS. 1-5 show the lower ring extension 158 having a lower ring frame 162, the upper ring extension 168 having an upper ring frame 172, and the top ring extension 178 having a top ring frame 182. The tubular member 154 inserts through the lower ring frame 162, upper ring frame 172 and top ring frame 182 for stable alignment to the side port connector 56, when the installation tool assembly 80 connects to the vent valve assembly 30. The arrangement supports the large tubular member 154 and reliably aligns the tubular member 154 in subsea conditions. FIGS. 1-5 also show an embodiment with the first motor 88 between the lower accessory plate 160 and the upper accessory plate 170. The first motor 88 is protected in this position between accessory plates 160, 170.

Embodiments of the method of the present invention are shown in sequence from FIGS. 1-5. The system 1 is assembled on barge at the surface before being deployed subsea. The clamp 86 is opened, and the hex drive rod 148 is aligned to be inserted into the center stem assembly 36. FIG. 1 shows the installation tool assembly 80 being lifted by connection means 144 above the vent valve assembly 30 and suction pile 10. The vent valve assembly 30 and the suction pile 10 are already made integral. FIG. 2 shows the steps of closing the clamp 86 with the first motor 88. With the lower connection interface 34 and the upper connection interface 98 fixed in the locking grooves 104, 114 of the clamp 86, the third motor 146 rotates the hex drive rod 148 to open the seal plate 58 so as to raise the seal plate 58 above the bottom vent valve body 44. The system 1 is open and lowered to the subsea location, filling the suction pile 10 and bottom vent valve body 44 with water. The system 10 can be guided in the descent to the desired location. The suction pile 10 self-embeds by weight in the desired location.

FIG. 3 shows the steps of closing the seal plate 58 to the second sealed position in the second sealing portion 50 of the bottom vent valve body 44. The hex drive rod 148 makes an opposite rotate to lower, instead of raise, the seal plate 58 toward the second sealing portion 50. The stop member 128 is actuated by the second motor 126 to the locked position. The hex drive rod 148 is not able to rotate, when the seal plate 58 is closed against the second sealing portion 150. Water can now be pumped from the suction pile 10 and the bottom vent valve body 44 through the side port opening 54 and side port connector 56. The tubular member 154 can provide the pumping action to suction water from the system, lowering and embedding the suction pile 10 into the soil at the desired location. The pumping of water can continue until the suction pile 10 reaches the desired depth at the desired location.

The next sequence of steps is shown in FIG. 4 with the stop member 128 being actuated to the unlocked position by the second motor 126. The third motor 146 now drives the hex drive rod 148 for the same opposite rotation to lower the seal plate to the first sealed position, adjacent the first sealing portion 148 of the bottom vent valve body 44. The seal plate 58 now seals the suction pile 10 so that the suction pile 10 remains at the desired depth. The side port opening 54 is no longer in fluid connection with the suction pile 10. No more water can be removed for lowering the suction pile 10.

Figure 5:
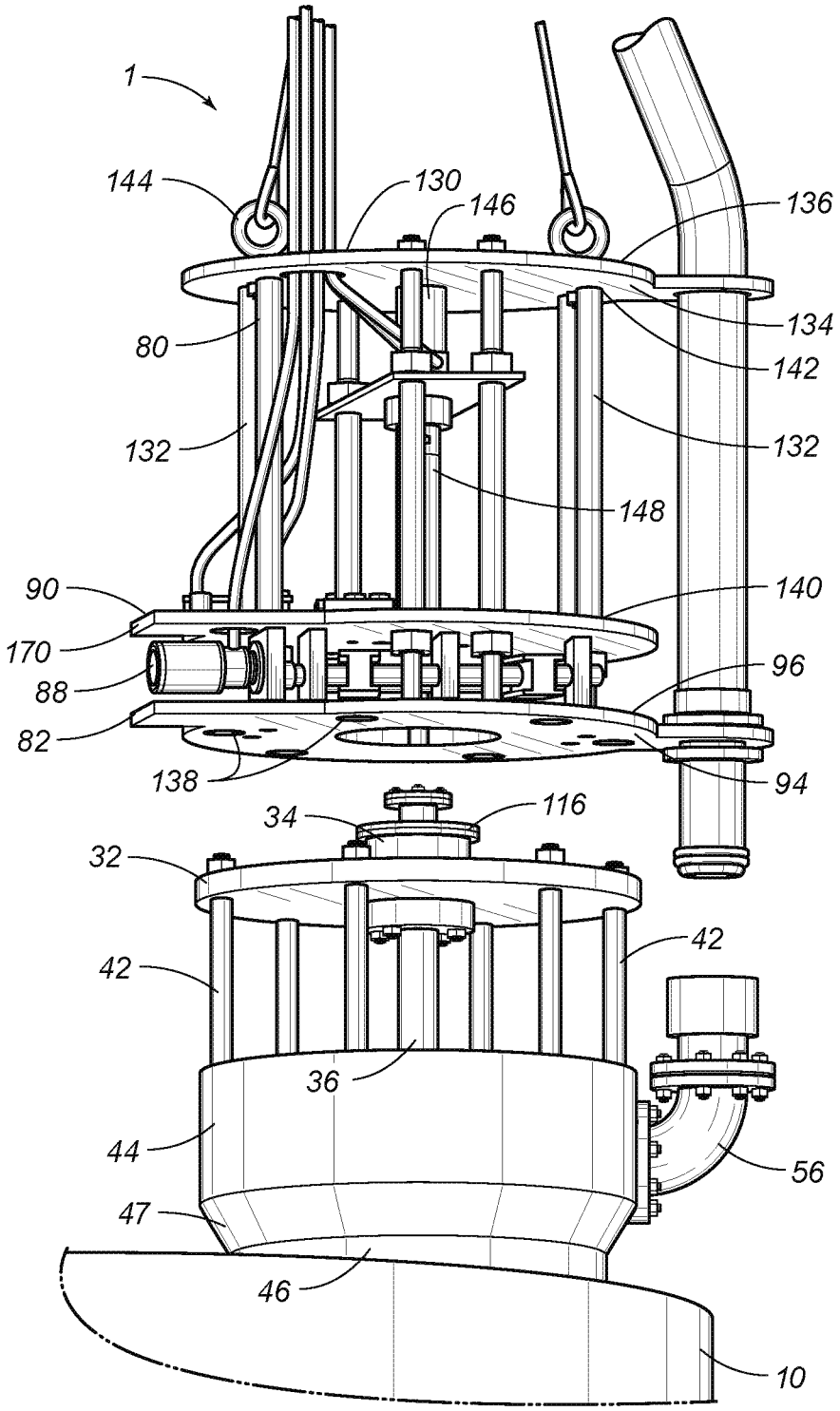
FIG. 5 is an exploded perspective view of an embodiment of the subsea system of the present invention, showing the installation tool assembly detached from the vent valve assembly and suction pile at the desired depth.

FIG. 5 shows some final steps of the method of the present invention. The first motor 88 actuates the clamp 86 to release the lower connection interface 34 and the upper connection interface 98. The locking grooves 104, 114 no longer hold the installation tool assembly 80 and vent valve assembly 30 together. The installation tool assembly 80 is now released and can be returned to the surface for reuse. The seal plate 58 remains in the first sealed position with the suction pile 10 anchored at the desired depth. The step of raising the installation tool assembly 80 can include withdrawing the hex drive rod 148 from the lower center stem connector 38 of the center stem assembly 36. The hex drive rod 148 can be used to rotate another center stem assembly of a different vent valve assembly.

When there is a tubular member 154 connected to the side port opening 54, the tubular member 154 must also be separated from the vent valve assembly. In this embodiment, the step of pumping water from the suction pile 10 includes pumping water through the tubular member 154 from the side port connector 56 and the side port opening 54. There can also be various connections to the surface, such as motor umbilicals 150. Connecting the motor umbilicals 150 can be performed during the step of assembling on barge. The motor umbilicals 150 remain attached to the installation tool assembly 80, so that there is no removal in the method of installing the suction pile 10. Other connections to the surface may provide other resources and power to the installation tool assembly 80 at the subsea location.

The present invention is a subsea support structure for an offshore installation to be maintained in the middle of the ocean for the performance of industrial processes, and sometimes supporting human lives. The subsea support structure includes a suction pile anchored at a desired depth. The suction pile of the present invention can be installed without a remote operated vehicle (ROV). The suction pile can be closed, and water can be pumped from the suction pile for embedding without an ROV. The valves can be opened and closed at the subsea location by the installation tool assembly attached to the suction pile, instead of sending an ROV to navigate the ocean currents. There is no need to make new connections and align ROV tools with knobs and valves on the suction pile. Less equipment is required because there is no need for the ROV and supporting equipment for the ROV. There is no need for the skilled personnel to pilot the ROV because all motors and actuators are already aligned to perform the required functions.

Even with the motors and other components aligned on the suction pile, the motors and other components are detachable from the suction pile. When anchored at the desired depth, the motors and other components are retrieved for reuse in another installation of another suction pile. The equipment is not lost with the permanent placement of the suction pile. The vent valve assembly seals, embeds, and seals again. A side port on the vent valve assembly can be opened in the opened position. The side port can also be sealed for pumping to embed. Then, the side port can be sealed another time for permanent anchoring at the desired depth.

The entire installation tool assembly can be detached from the suction pile and vent valve assembly. The lower connection interface and the upper connection interface are clamped together in the installation tool assembly, so that the retrievable component includes the clamping device. The vent valve assembly still should have a suitable complementary structure to the upper connection interface, such as the lower connection interface of the present invention, in order to allow for the clamping to connect the installation tool assembly and the vent valve assembly. The suction pile, vent valve assembly and detachable installation tool assembly are deployed from a surface while attached together as a single unit. The connections and alignments can be checked on barge, so that the system is ready to embed and anchor upon reaching the desired location. These alignments and relationship between components are also retrieved on the installation tool assembly of the present invention.

The foregoing disclosure and description of the invention is illustrative and explanatory thereof. Various changes in the details of the illustrated structures, construction and method can be made without departing from the true spirit of the invention.

I claim:

1. A subsea support system, comprising:

a suction pile being comprised of a generally cylindrical body having a top pile surface with a pile vent opening on a closed end and a pile skirt on an opened end;

a vent valve assembly made integral with said pile vent opening, wherein said vent valve assembly comprises:

a top vent valve plate;

a lower connection interface made integral with said top vent valve plate;

a center stem assembly being comprised of a lower center stem connector and a lower threaded center stem bolt body, said lower center stem connector being mounted on an end of said lower threaded center stem bolt body above said lower connection interface, center stem assembly extending through said top vent valve plate;

a seal plate being comprised of a circular plate body, a bottom alignment pin extending downward from said circular plate body, and a stem retainer connecting said circular plate body with said lower threaded center stem bolt body;

a rod guide being comprised of a frame with a center frame hole aligned with said bottom alignment pin;

a bottom vent valve body having a tubular connection portion made integral with said pile vent opening, a first sealing portion adjacent said tubular connection portion, a side port portion adjacent said first sealing portion, and a second sealing portion, said side port portion being between the first and second sealing portions; and a plurality of vent valve stem assemblies, each vent valve stem assembly being arranged on an edge of said bottom vent valve body facing said top vent valve plate so as to maintain position of said top vent valve plate relative to said bottom vent valve body; and an installation tool removably attached to said vent valve assembly, wherein said installation tool assembly comprises:

a lower mounting plate being removably engaged to said top vent valve plate and having a center lower mounting hole, said lower connection interface insertable through said center lower mounting hole;

a clamp centered on said lower mounting plate;

a first motor attached to said lower mounting plate and connected to said clamp;

an upper mounting plate being fixedly attached to said lower mounting plate and having a center upper mounting hole aligned with said center lower mounting hole, said upper mounting plate having a bottom side facing said lower mounting plate and a top side opposite said bottom side;

an upper connection interface fixedly attached to said bottom side of said upper mounting plate, said upper connection interface extending downward toward said lower mounting plate;

a second motor attached to said top side of said upper mounting plate;

a locking means with a stop member, said second motor actuating said stop member from a locked position and an unlocked position;

a top installation tool plate being fixedly attached to said upper mounting plate and said lower mounting plate and having a lower side facing said top side of said upper mounting plate and an upper side opposite said lower side;

a plurality of installation tool stem assemblies mounted on said lower mounting plate, each installation tool stem assembly being arranged around said center mounting hole of said lower mounting plate facing upward toward said top installation tool plate so as to maintain position of said top installation tool plate, said upper mounting plate and said lower mounting plate;

a third motor attached to said lower side of said top mounting plate; and a hex drive rod connected to said third motor, said third motor driving rotation of said hex drive rod, said hex drive rod extending from said motor toward said top side of said upper mounting plate, through said upper mounting plate and into said upper connection interface, said hex drive rod removably engaging with said lower center stem connector of said vent valve assembly.

2. The subsea support system, according to claim 1, wherein said side port portion is comprised of a side port opening through said bottom vent valve body and a side port connector in fluid connection with said side port opening on an exterior of said side port portion.

3. The subsea support system, according to claim 1, wherein said seal plate has an opened position, a second sealed position, and a first sealed position, said second sealed position closing seal plate to said second sealing portion of said bottom vent valve body, said first sealed position closing said seal plate to said first sealing portion of said bottom vent valve body, wherein said second sealed position corresponds to fluid connection between said side port portion and said side port connector, and wherein said first sealed position corresponds to closing said tubular connection portion to said side port portion of said bottom vent valve body.

4. The subsea support system, according to claim 1, further comprising:

sealing means around a perimeter of said circular plate body of said seal plate.

5. The subsea support system, according to claim 1, further comprising:

a transition zone between said first sealing portion and said tubular connection portion.

6. The subsea support system, according to claim 1, wherein said lower mounting plate is comprised of a plurality of peripheral holes, each peripheral hole being aligned with a corresponding vent valve stem assembly, wherein said upper mounting plate is comprised of a plurality of upper stem holes, each upper stem hole being aligned with a corresponding installation tool stem assembly, each installation tool stem assembly inserting through a respective upper stem hole, and wherein said top installation plate is comprised of a plurality of tool plate holes, each tool plate hole being aligned with a corresponding installation tool stem assembly, each installation tool stem assembly inserting through a respective tool plate stem hole.

7. The subsea support system, according to claim 6, further comprising:

connection means for at least one installation tool stem assembly above said upper side of said top installation tool plate.

8. The subsea support system, according to claim 1, wherein said lower mounting plate is comprised of a lower circular mounting portion complementary to said top vent valve plate, said center lower mounting hole being centered in said lower circular mounting portion, and a lower ring extension radial to said lower circular mounting portion, wherein said top installation plate is comprised of a top circular mounting portion complementary to said upper circular mounting portion and said lower circular mounting portion, and a top ring extension radial to said top circular mounting portion and aligned with said upper ring extension and said lower ring extension, wherein said lower ring extension is comprised of a lower ring frame, and wherein said top ring extension is comprised of a top ring frame, the system further comprising:

a tubular member being inserted through said top ring frame, and said lower ring frame and being connected to said side port connector, wherein said tubular member is in removable fluid connection to said bottom vent valve body through said side port connector.

9. The subsea support system, according to claim 1, wherein said lower mounting plate is comprised of a lower circular mounting portion complementary to said top vent valve plate, said center lower mounting hole being centered in said lower circular mounting portion, and a lower accessory plate extending from said lower circular mounting portion, wherein said upper mounting plate is comprised of an upper circular mounting portion complementary to said lower circular mounting portion, said center upper mounting hole being centered in said upper circular mounting portion, and an upper accessory plate extending from said upper circular mounting portion and aligned with said lower accessory plate, and wherein said first motor is positioned between said upper accessory plate and said lower accessory plate.

10. The subsea support system, according to claim 1, wherein said clamp comprises:

a first arcuate arm having a first pivot point attached to said lower mounting plate and first locking groove facing toward said center lower mounting hole; and a second arcuate arm having a second pivot point attached to said lower mounting plate and a second locking groove facing toward said center lower mounting hole, wherein said lower connection interface to said upper connection interface are friction fit with said first locking groove and said second locking groove, and wherein said first locking groove and said second locking groove cooperatively engage said lower connection interface to said upper connection interface for a locked connection between said vent valve assembly and said installation tool assembly.

11. The subsea support system, according to claim 10, wherein said lower connection interface is comprised of a lower flanged end, wherein said upper connection interface is comprised of an upper flanged end, and wherein said lower flanged end is adjacent to said upper flanged end within said first locking groove and said second locking groove in said locked connection between said vent valve assembly and said installation tool assembly.

12. The subsea support system, according to claim 10, wherein said first motor comprises a motor unit and an actuating member, wherein said actuating member engages each arcuate arm, wherein said first arcuate arm rotates on said first pivot toward said second arcuate arm and said second arcuate arm rotates on said second pivot toward said first arcuate arm for a closed clamp position, and wherein said first arcuate arm rotates on said first pivot away from said second arcuate arm and said second arcuate arm rotates on said second pivot away from said first arcuate arm for an opened clamp position.

13. The subsea support system, according to claim 12, further comprising:

a locking frame mounted on said lower mounting plate, said locking frame aligning said actuating member to said first arcuate arm and said second arcuate arm.

14. The subsea support system, according to claim 1, wherein said locked position of said stop member corresponds to said stop member in friction fit engagement with said hex drive rod, wherein said unlocked position of said stop member corresponds to said stop member released from friction fit engagement with said hex drive rod, and wherein said stop member is in said locked position, when said seal plate is in said second sealed position.

15. The subsea support system, according to claim 1, further comprising:

a plurality of motor umbilicals, each motor umbilical connecting to a respective motor of said installation tool assembly.

16. The subsea support system, according to claim 1, further comprising:

a support plate positioned by corresponding installation tool stem assemblies aligned through the top installation tool plate, upper mounting plate, and lower mounting plate, wherein said third motor fixedly attaches to said support plate, said third motor being positioned between said support plate and said top installation tool plate.

17. A method for installation of a subsea support structure, the method comprising the steps of:

assembling a suction pile with a vent valve assembly of claim 1, said suction pile being comprised of a generally cylindrical body having a top pile surface with a pile vent opening on a closed end and a pile skirt on an opened end, said vent valve assembly being made integral with said pile vent opening;

opening said clamp of said installation tool assembly of claim 1;

inserting said hex drive rod into said lower center stem connector of said vent valve assembly;

closing said clamp of said installation tool assembly with said first motor, said vent valve assembly being connected to said installation tool assembly;

opening said seal plate by raising said seal plate above said bottom vent valve body by rotation of said hex drive rod with said third motor, wherein said seal plate has an opened position, a second sealed position, and a first sealed position, said second sealed position closing seal plate to said second sealed portion of said bottom vent valve body, said first sealed position closing said seal plate to said first sealed portion of said bottom vent valve body, wherein said second sealed position corresponds to fluid connection between said side port portion and said side port connector, and wherein said first sealed position corresponds to closing said tubular connection portion to said side port portion of said bottom vent valve body;

lowering said suction pile, said vent valve assembly, and said installation tool assembly to a subsea location, said suction pile and said bottom vent valve body being filled with water;

closing said seal plate to said second sealed position by opposite rotation of said hex drive rod with said third motor;

actuating said stop member to said locked position by said second motor;

pumping water from said bottom vent valve body and from said suction pile through said side port opening and said side port connector so as to set said suction pile at a desired depth;

actuating said stop member to said unlocked position by said second motor;

closing said seal plate to said first sealed position by additional opposite rotation of said hex drive rod with said third motor;

opening said clamp of said installation tool assembly with said first motor, said vent valve assembly being released from said installation tool assembly; and raising said installation tool assembly from said suction pile and said vent valve assembly.

18. The method for installation of a subsea support structure, according to claim 17, further comprising the steps of:

connecting motor umbilicals to said first motor, said second motor, and said third motor; and connecting a tubular member to said top installation plate, said upper mounting plate, and said lower mounting plate, wherein said tubular member connects to said side port connector of said vent valve assembly when said vent valve assembly is connected to said installation tool assembly, and wherein said tubular member releases from said side port connector of said vent valve assembly when said vent valve assembly releases from said installation tool assembly.

19. The method for installation of a subsea support structure, according to claim 18, wherein the step of pumping water from said bottom vent valve body and from said suction pile through said side port opening and said side port connector comprises pumping through said tubular member.

20. The method for installation of a subsea support structure, according to claim 18, wherein the step of raising said installation tool assembly from said suction pile and said vent valve assembly comprises withdrawing said hex drive rod from said lower center stem connector of said vent valve assembly.

* * * * *